United States Patent [19]

Joy

[11] 4,214,998

[45] Jul. 29, 1980

[54] QUATERNARY AMMONIUM COMPOUNDS USEFUL AS FABRIC SOFTENING AGENTS

[75] Inventor: David R. Joy, Middlesbrough, England

[73] Assignee: Imperial Chemical Industries Limited, London, England

[21] Appl. No.: 10,597

[22] Filed: Feb. 7, 1979

[30] Foreign Application Priority Data

Feb. 24, 1978 [GB] United Kingdom ..... 7461/78

[51] Int. Cl.[2] ..... D06M 13/46

[52] U.S. Cl. ..... 252/8.8; 252/153; 252/547; 260/567.6 M

[58] Field of Search ..... 252/8.8 R, 8.8 AJ, 153, 252/528, 547, DIG. 14; 260/567.6 M

[56] References Cited

U.S. PATENT DOCUMENTS

| | | | |
|---|---|---|---|
| 3,216,944 | 11/1965 | Fredrickson | 252/8.8 |
| 3,395,100 | 7/1968 | Fisher et al. | 252/8.8 |
| 3,505,221 | 4/1970 | Waldman et al. | 252/8.75 |
| 3,509,049 | 4/1970 | Zweidler | 252/8.75 |
| 3,625,891 | 12/1971 | Waldman et al. | 252/8.8 |
| 3,660,286 | 5/1972 | Sepulueda et al. | 252/8.8 |
| 3,781,204 | 12/1973 | Katsumi et al. | 252/8.75 |
| 3,803,137 | 4/1974 | Egan et al. | 260/567.6 M |
| 3,979,307 | 9/1976 | Kolaian et al. | 252/8.78 |

FOREIGN PATENT DOCUMENTS

| | | | |
|---|---|---|---|
| 2438127 | 3/1975 | Fed. Rep. of Germany | 252/8.8 |
| 729189 | 5/1955 | United Kingdom | 260/567.6 M |

*Primary Examiner*—P. E. Willis, Jr.

*Attorney, Agent, or Firm*—Cushman, Darby & Cushman

[57] ABSTRACT

Fabric softening compositions comprise alcoholic solutions or aqueous dispersions of a mixture of quaternary ammonium compounds having the general formula:

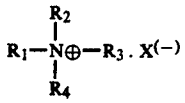

in which X represents a quaternary anion, for example chloride, bromide, iodide, methylsulphate, $R_1$ and $R_2$, which may be the same or different within a molecule, are long chain alkyl groups containing from 13 to 19 carbon atoms in each group, the groups being both straight chain and branched and in which the amount of branching is in the range between 30% and 70%, and particularly mixtures of quaternary compounds in which the substituents $R_1$ and $R_2$ are alkyl groups containing 13 and 15 carbon atoms comprising 65 to 75% $C_{13}$ groups with 35 to 25% $C_{15}$ groups (the percentages being calculated on the total of long chain alkyl groups) with 40 to 55 wt % straight chain and 60 to 45 wt % 2-alkyl branched chain where the 2-alkyl groups is predominantly methyl.

8 Claims, No Drawings

QUATERNARY AMMONIUM COMPOUNDS USEFUL AS FABRIC SOFTENING AGENTS

This invention relates to mixtures of quaternary ammonium derivatives of long chain aliphatic amines and to textile treating compositions based on these derivatives.

Various proposals have been made for using quaternary ammonium derivatives of long chain amines in the formulation of compositions for treating textiles, for example in fabric softening compositions. Although such compositions have proved to be useful, it has been difficult to formulate the compositions in an easily handleable form and currently compositions tend to be in the form of thick or semi-liquid pastes.

We have now found that certain quaternary ammonium derivatives can be formulated into readily handleable compositions.

Accordingly, the present invention comprises a composition comprising a mixture of quaternary ammonium compounds having the general formula:

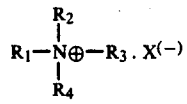

in which

X represents a quaternary anion, for example chloride, bromide, iodide, methylsulphate, $R_1$ and $R_2$, which may be the same or different within a molecule, are long chain alkyl groups containing from 13 to 19 carbon atoms in each group, the groups being both straight chain and branched and in which the amount of branching is in the range between 30% and 70%. Preferably the degree of branching is about 50%.

$R_3$ and $R_4$, which may be the same or different within a molecule, are short chain alkyl groups containing one to four carbon atoms in each group, preferably methyl.

Preferably, in $R_1$ and $R_2$ the branching is predominantly of 2-methyl groups.

In preferred embodiments of this invention, the substituents $R_1$ and $R_2$, which may be the same or different within a molecule, are long chain alkyl groups containing 13 or 15 carbon atoms in each group, the groups being both straight chain and branched and in which the amount of branching is in the range between 30 and 70%. More preferably the substituents $R_1$ and $R_2$ are long chain alkyl groups containing 13 or 15 carbon atoms comprising approximately 65 to 75% $C_{13}$ groups with approximately 35 to 25% $C_{15}$ groups (these percentages being calculated on the total of long chain alkyl groups) with approximately 40 to 55 wt % straight chain and 60 to 45 wt % 2-alkyl branched chain where the 2-alkyl group is predominantly methyl.

Compositions according to this invention may be prepared by the reaction of a suitable quaternising agent $R_4X$ with either a secondary amine $R_1R_2NH$ or a tertiary amine, $R_1R_2R_3N$, where $R_1$, $R_2$, $R_3$, $R_4$ and X have the same meaning as hereinbefore described. The secondary amine $R_1R_2NH$ may be prepared in one of a number of ways, for example (a) by heating the corresponding primary amine with a suitable catalyst to eliminate ammonia, (b) by alkylating a primary amine with an equimolar amount of an alcohol or an aldehyde, or (c) by alkylating ammonia with two mole equivalents of an alcohol or an aldehyde. The tertiary amine $R_1R_2R_3N$ may be prepared by, for example (a) alkylating a secondary amine with methanol or formaldehyde, or (b) alkylatiing a short chain primary amine, for example monoethylamine with an alkylating agent, for example an alcohol, aldehyde, alcohol sulphate or alkylhalide.

A particularly suitable source of primary amine for use in the preparation of the secondary amine is a mixture of amines, $R_1NH_2$ and $R_2NH_2$ in which $R_1$ and $R_2$ have the same meaning as hereinbefore defined, and which comprises approximately 65 to 75% $C_{13}$ and approximately 35 to 25% $C_{15}$ amines (these percentages being calculated on the total of long chain alkyl groups) with approximately 40 to 55 wt % straight chain and 60 to 45 wt % 2-alkyl branched chain where the 2-alkyl group is predominantly methyl. Such a mixture of amines which is particularly suitable is that known as Synprolam 35 (Registered Trade Mark).

The quaternised products of this invention are highly effective fabric softeners. They can be obtained as free flowing liquids when dissolved in suitable alcoholic solvents. The preferred solvents are lower alcohols, for example methanol, ethanol, propanols and butanols, the more preferred solvent being isopropanol. The preferred concentrations of the quaternised products of this invention depend to some extent on the solubility in the particular solvent and on the viscosity of the product obtained but in general it is clearly advantageous economically to prepare a fabric softener with as high a concentration of quaternary compound as possible. Solutions containing less than 50% quaternary product are unlikely to be attractive therefore. Compositions containing of the order of 70 to 75 wt % of quaternary compound in isopropanol are easily prepared and it is believed that, if desired, compositions can be prepared containing up to 80 to 85% of quaternary compound. The products of the invention are also readily dispersible in cold water to give stable dispersions which may contain, for example 1 to 20%, and more preferably 4 to 10%, of quaternary ammonium salt and which may be formulated by the addition of one or more suitable additives commonly used in this art, for example dye, perfume, optical brightener, and non-ionic surfactant. When so formulated, the products of this invention are particularly valuable as fabric softeners and impart a softness to fabric which is at least as good as that imparted by prior art formulations. Moreover, the rewettability properties of fabrics treated with formulations incorporating the products of this invention are superior to those of fabrics treated with the prior art formulations.

The products of this invention also impart anti-static properties to synthetic fabrics, for example "Nylon" and "Terylene".

EXAMPLE 1

Secondary amine was prepared by heating a mixture of amines, Synprolam 35 (Registered Trade Mark), with a 50 to 55% (by weight) nickel on kieselguhr catalyst (Girdler G49B). The Synprolam 35 amine mixture had the composition (% wt/wt):

n-tridecylamine: 36%
2-methyldodecylamine: 30%
other $C_{13}$ amines: 3%
n-pentadecylamine: 11%
2-methyltetradecylamine: 16%
other $C_{15}$ amines: 4%

32 g. of the secondary amine product was reacted with 22 g. of methyl chloride, 9 g. isopropanol and 16.8 g. sodium bicarbonate at 123° C. and a pressure within the range 260 to 300 psig for 5 hours. After filtration and cooling, the product was a dark straw-coloured mobile liquid containing 6.8% amine, 0.3 hydrochloride and 72.0% quaternary ammonium compound.

EXAMPLE 2

Secondary amine was prepared by alkylating a mixture of amines, Synprolam 35 (Registered Trade Mark), with a $C_{13}$ to $C_{15}$ aldehyde having the composition (% wt/wt):

n-tridecanal: 35%
2-methyldodecanal: 30%
other $C_{13}$ aldehydes: 4%
n-pentadecanal: 14%
2-methyltetradecanal: 14%
other $C_{15}$ aldehydes: 4%

(This analysis shows the composition of the active components in the mixture relative to each other. Small quantities of other compounds, for example hydrocarbons, $C_{13}$ to $C_{15}$ alcohol may also be present).

51.6 g. of the product was reacted with 43 g. methyl chloride, 135 g. isopropanol and 25.5 g. sodium bicarbonate at 124° C. and a pressure within the range of 380 to 460 psig for 5 hours. After cooling and filtration, the product was a straw coloured mobile liquid containing 1.3% amine, 2.4% amine hydrochloride and 74.0% quaternary ammonium compound.

EXAMPLE 3

Quaternary ammonium salt prepared as in Example 1 (8 g. of 72% solution in isopropanol) was stirred cold with a mixture of 0.0003 g. dye (Lissamine Blue 2BR) 0.2 g. nonionic surfactant (Synperonic A2), 0.1 g. optical brightener (Calcofluor RWP ex American Cyanamind Co), 0.15 g. perfume (Lavender Floral GC 123 ex Proprietary Perfumes Ltd) and 91.5 g. water. The product was a stable dispersion.

Two similar formulations were prepared in which the quaternary ammonium salt was replaced by identical amounts of (1) dihydrogenated tallow dimethyl ammonium chloride (Arquad 2HT ex Akzo-Chemie, UK Armour Hess Div) and (2) 1-tallowalkyl amidoethyl 2-tallowalkyl-3-methyl imidazolinium methosulphate (Varisoft 475 l ex Ashland Oil Co).

It was necessary to heat the formulation containing Arquad 2HT at about 60° C. in order to obtain a stable dispersion.

TESTING OF THE FORMULATIONS

(a) Treatment

Samples of terry towelling were washed in a conventional detergent formulation ("Tide"), thoroughly rinsed with water, and then immersed in water containing the particular formulation under test at a level of 0.2 wt % of active quaternary ammonium compound ingredient based on the weight of fabric. This procedure was repeated until six treatments had been applied in each case.

(b) Evaluation of Softness

When asked to choose the softest of pairs of treated fabric a panel of 14 people (as part of balanced incomplete paired comparison tests involving other experimental fabric softeners) gave the following choices:

| Fabric Softener Used | Times chosen as being softer than the other sample under comparison |
|---|---|
| None | 3½ |
| Arquad 2HT | 20 |
| Varisoft 475 | 5½ |
| Quaternary Ammonium compound of Ex. 1 | 19 |

(½ indicates that the judge could not distinguish between samples).

(c) Rewettability Test

Samples of the treated terry towelling measuring about 25 cm×4 cm were suspended vertically so that the bottom 3 cm were immersed in a 0.18% w/v aqueous solution of Lissamine Red 2G dye. The distance travelled by the dye front up the towelling in 30 minutes was measured. The results are as follows:

| Fabric Softener Used | Distance (cm) travelled |
|---|---|
| None | 18 |
| Arquad 2HT | 17 |
| Varisoft 475 | 15 |
| Quaternary Ammonium compound of Ex. 1 | 18 |

From these tests it is clear that compounds according to the present invention can be formulated into fabric softeners having excellent softening and rewettability properties. Moreover contrary to some preferences expressed in this art that the better fabric softeners are those containing compounds with long chain alkyl groups of at least 16, say 16 to 18, carbon atoms (and preferably straight chain rather than branch chain), these tests show that very effective fabric softeners can be formulated from compounds with $C_{13}$ to $C_{15}$ long chain alkyl groups which have a considerable amount of branching in them.

I claim:

1. A composition comprising a mixture of quaternary ammonium compounds having the formula:

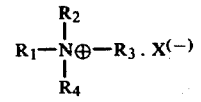

in which X represents a quaternary anion; $R_1$ and $R_2$, which may be the same or different within a molecule, are long chain alkyl groups containing from 13 to 15 carbon atoms in each group, the groups being both straight chain and branched, 65 to 75% $C_{13}$ groups with 35 to 25% $C_{15}$ groups, the percentages being calculated on the total of long chain alkyl groups, with 40 to 55 wt % straight chain and 60 to 45 wt % 2-alkyl branched chain where the 2-alkyl group is predominantly methyl; and $R_3$ and $R_4$, which may be the same or different within a molecule, are short chain alkyl groups containing one to four carbon atoms in each group.

2. A fabric softening composition comprising a solution or dispersion in a liquid medium of the composition of claim 1.

3. A fabric softener composition as claimed in claim 1 in which the liquid medium comprises methanol, ethanol, a propanol or a butanol.

4. A fabric softening composition as claimed in claim 3 in which the solvent comprises isopropanol.

5. A fabric softening composition as claimed in claim 2 comprising at least 50% by weight of the composition of claim 1 in an alcoholic solvent.

6. A fabric softening composition as claimed in claim 2 comprising at least 70% by weight of the composition of claim 1 in an alcoholic solvent.

7. A fabric softening composition as claimed in claim 2 comprising a dispersion in water of 1 to 20% by weight of the composition of claim 1.

8. A composition as claimed in claim 1 in which X is chloride, bromide, iodide or methylsulphate.

* * * * *